United States Patent [19]
Barber et al.
[11] 3,930,448
[45] Jan. 6, 1976

[54] ROCKET-DEPLOYED BALLOON FOR POSITION MARKER

[75] Inventors: William H. Barber, Brandywine, Md.; Werner F. Beckert, Las Vegas, Nev.; Ottmar H. Dengel, Front Royal, Va.

[73] Assignee: The United States of America as represented by the Secretary of the Navy, Washington, D.C.

[22] Filed: Aug. 7, 1974

[21] Appl. No.: 495,479

Related U.S. Application Data

[63] Continuation-in-part of Ser. No. 265,931, June 23, 1972, abandoned.

[52] U.S. Cl. ..... 102/34.1; 102/34.4; 116/124 B
[51] Int. Cl.[2] ..... F42B 13/42
[58] Field of Search ..... 116/124 B; 102/34.1, 34.4, 102/63, 89

[56] References Cited

UNITED STATES PATENTS

| | | | |
|---|---|---|---|
| 79,963 | 7/1868 | Detwiller | 102/34.1 X |
| 2,778,332 | 1/1957 | Talbot | 116/124 B |
| 3,118,638 | 1/1964 | Rohr | 102/49.5 |
| 3,132,626 | 5/1964 | Reid | 116/124 B |
| 3,156,185 | 11/1964 | Hermann et al. | 102/63 |
| 3,381,655 | 5/1968 | Rozzelle | 116/124 B |
| 3,395,877 | 8/1968 | MacFadden et al. | 244/33 |
| 3,612,857 | 10/1971 | Beatty | 116/124 B |

FOREIGN PATENTS OR APPLICATIONS

| | | | |
|---|---|---|---|
| 1,325,641 | 3/1963 | France | 116/124 B |
| 694,124 | 9/1965 | Italy | 116/124 B |

*Primary Examiner*—Verlin R. Pendegrass
*Attorney, Agent, or Firm*—R. S. Sciascia; J. A. Cooke; F. K. Yee

[57] ABSTRACT

A portable, rocket-deployed signaling system for deploying a pin-point location marker including a tractor rocket propulsion unit and attached payload container launched from a hand-held tube. The payload comprises an inflatable marker balloon, a gas generator for inflating the balloon and a tether line connecting the balloon to the launcher tube. A coupling pin, secured to the tether line at a predetermined length from the end attached to the launcher tube and removably supported on the payload container, is pulled subsequent to launch to permit the container to separate and deploy the balloon. A percussion igniter then actuates the gas generator to inflate the balloon with the generator separating after inflation.

13 Claims, 12 Drawing Figures

55
52
50
48
56
54
44
44
49
46
16
64
64
66
55
4
4
52
14
24
44
44
28
22
40
38
22
26
33
35
32
33
30
24
36
34
28
24
26

ROCKET-DEPLOYED BALLOON FOR POSITION MARKER

CROSS REFERENCE TO RELATED APPLICATIONS

This application is a continuation-in-part of application Ser. No. 265,931 filed Jun. 23, 1972, and now abandoned.

BACKGROUND OF THE INVENTION

The present invention relates generally to site markers, distress signals, rescue beacons and the like, and more particularly, to a rocket-deployed, tethered signal balloon as a pin-point location marker.

At present, no reliable system exists to deploy a long duration rescue signal, such as a balloon, under extreme conditions. The need for such a signaling device becomes evident when one considers the problems of locating a pilot downed, for example, in a hostile environment or dense jungle terrain. Existing systems include smoke bombs, parachute flares shot from a pistol, radio beacons, xenon flashers and the like, but these are not effective in all situations. Smoke bombs and parachute flares are not particularly of long duration and, therefore, must be employed when a rescue craft is in sight. Radio beacons and xenon flashers are longer lasting, but may be employed only in open areas to be effective. Present balloons are unsatisfactory since they are inflated at ground level and must be deployed manually to a height that can be seen by rescue craft, thus precluding their use in densely overgrown locations since the inflated balloon will probably be snagged or snarled by the vegetation before an effective deployment height can be achieved. Automatic balloon deployment systems have the additional disadvantages of not permitting the user the flexibility of when and where to deploy the marker, an important consideration if the user is under hostile surveillance at the distress location.

The instant invention obviates the disadvantages of existing signaling systems by providing a long-duration, balloon marker packaged into a self-contained, compact, portable system which is deployed from a tube by a hand-fired rocket to a considerable height before inflation is automatically initiated and remains tethered to the tube. This permits marker deployment when and where desired by the user, and the rocket deployment of the packaged balloon ensures clearance of all obstacles before inflation.

SUMMARY OF THE INVENTION

Accordingly, an object of the present invention is to provide a pin-point position marker of long duration.

Another object of the present invention is to provide a position marker that may be deployed readily under extreme and densely overgrown situations.

Another object of the instant invention is to provide a tethered, balloon-type marker signal.

Still another object of the instant invention is to provide a rocket-deployed, tethered balloon position marker.

Yet another object of the invention is to provide a rocket-deployed, tethered balloon marker that inflates at the deployment altitude.

A further object of the instant invention is to provide a rocket-deployed, tethered balloon position marker that is compact, light-weight, and readily usable in extreme situations.

Briefly, these and other objects of the present invention are attained by a tethered marker balloon of high visibility that is deployed from a hand-held rocket launcher and inflated at a substantial elevation. A solid-fuel, tractor rocket propels to a substantial height a payload casing containing a balloon, tether line and gas generator, paying out the tether line attached to a pin holding together the sections of the casing. After a predetermined length of cord, the pin is pulled, releasing the casing to deploy the balloon. The rocket separates from and activates the inflating gas generator which detaches from the balloon after inflation.

BRIEF DESCRIPTION OF THE DRAWINGS

A more complete understanding of the invention and the many attendant advantages thereof will be readily appreciated as the same becomes better understood by reference to the following detailed description, when considered in connection with the accompanying drawings wherein.

DESCRIPTION OF THE PREFERRED EMBODIMENT

Figure 1:
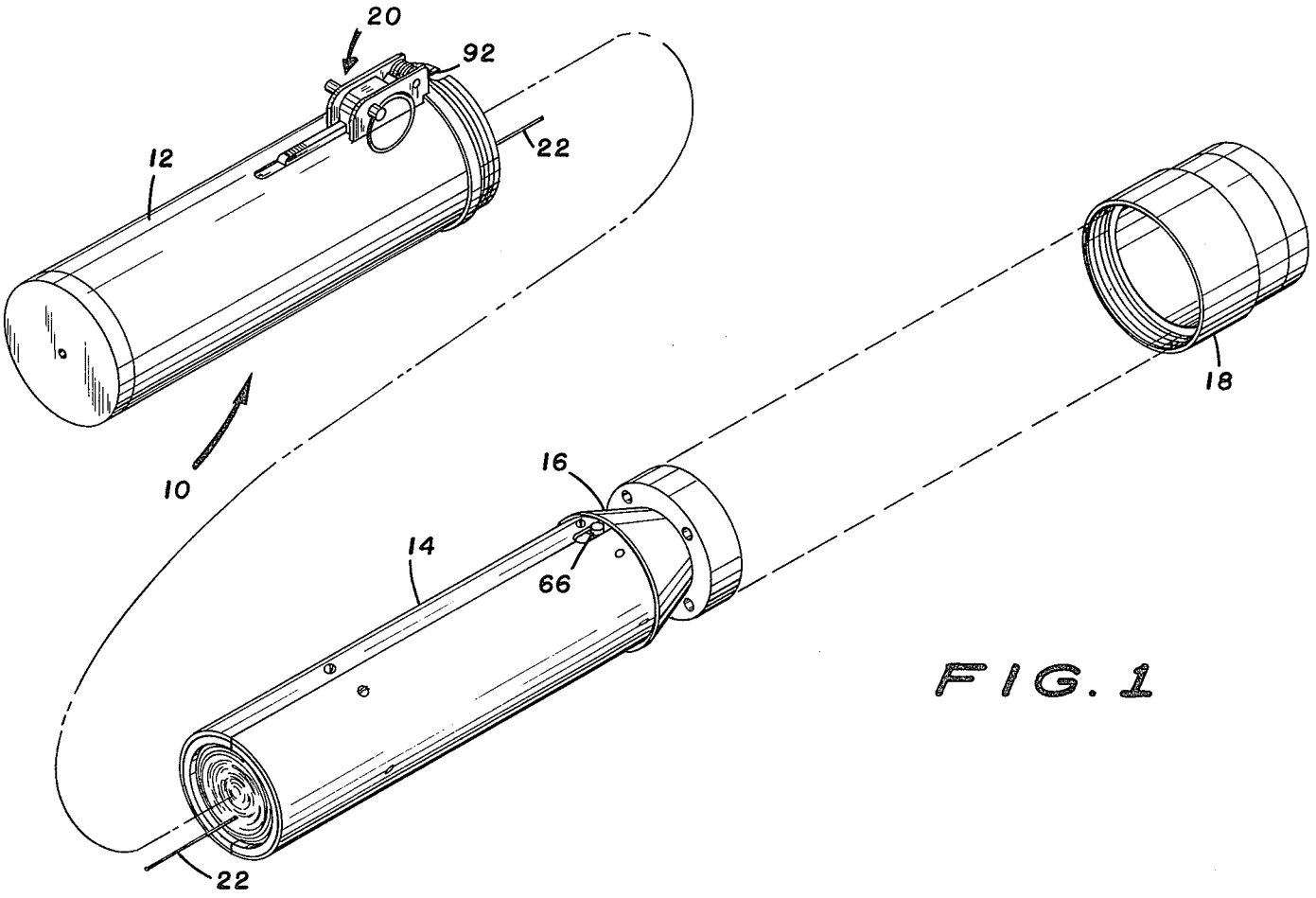
FIG. 1 is a view of the rocket-deployed balloon marker system.

Referring now to the drawings, wherein like reference numerals designate corresponding parts throughout the several views, there is shown in FIG. 1 an embodiment of the rocket-deployed balloon marker system 10 of the present invention, partially disassembled for greater clarity of viewing. The balloon marker system 10 includes a launcher/container tube 12, a payload case 14 attached to a tractor-type rocket motor 16 which fits within the tube 12, and a cap 18 for closing the tube. Tube 12, of a durable fiberglass material or the like, serves as the storage container for the marker balloon and as the launcher during balloon deployment. Cap 18 is threaded onto the tube 12 and removed just prior to deployment of the marker. Approximate the open end of the tube 12 is a slide-release ignition actuator 20, shown in more detail in FIG. 5, which resembles the slide switch on a flashlight and used to fire the rocket 16. A tether line 22 attaches the marker balloon to the launcher tube 12.

Figures 2A, 2B, 2C:
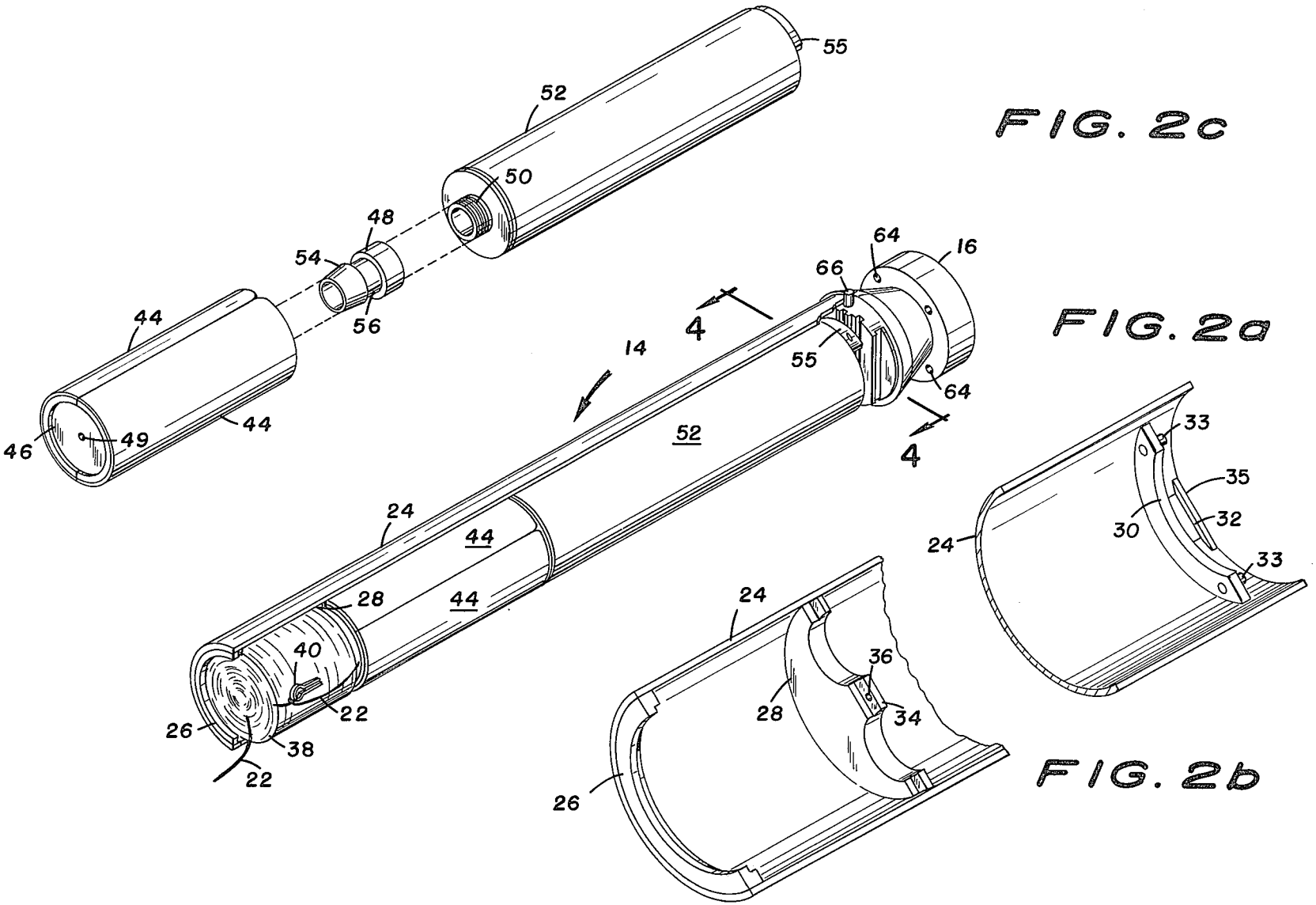
FIGS. 2a – 2c are exploded views of the rocket and the payload container.

FIGS. 2 show in greater detail the components of the balloon marker system packaged within the payload case 14, a hollow cylinder of fiberglass-reinforced phenolic or similar material, split longitudinally to form similar half shells, or clamshells 24, one of which is shown removed in FIG. 2*a*. Each of the clamshells 24 has thereon an upstanding, semi-circular circumferential retaining ring 26 approximate the aft end, a perforated half disk 28 a short distance from the retaining ring 26, and an upstanding, rocket positioning ring 30 adjacent the forward edge. See FIG. 2b. Ring 30 has a receiving groove 32 and an adjacent, projecting tongue 35 provided thereon along with a pair of longitudinally-extending pins 33, one each at the ends of the ring. Each half disk 28 has a center portion 34 with a hole 36 therein, the purpose of which will be considered more fully below. A ball 38 of the tether line 22, made of braided nylon, dacron, or similar material, and approximately 450 feet in length, specially wound to pay out easily from the center thereof, is received in the space between the retaining ring 26 and the half disk 28. See FIG. 2*a*. One end of the line 22 is attached to the closed end of tube 12 to tether the balloon after inflation and the other end is passed through the perforation in the half disk 28 and attached to the marker balloon. At a predetermined distance from the tethered end of the line, for example 400 feet, a pin 40, similar to a cotter pin, is attached to the line 22. The pin 40 is passed through the hole 36 in each of the half disk 28 to fasten the clamshells 24 together during marker system deployment and is forcibly removed by the tether line 22 to permit the clamshells to separate, as will be discussed more fully below.

Forward of the tether line ball 38 is the marker balloon 42 (not visible in FIG. 2*a*), completely deflated and folded surrounded by a protective sheath 44 comprised of two, semi-circular half shells, similar in construction and material as the clamshells 24. A disk 46 closes the aft end of the assembled sheath, the disk 46 having central aperture 49 to permit passage of the tether line 22 to the balloon 42. See FIG. 2*c*. Additional protection for the balloon may be provided by encasing it within a flexible covering, such as plastic or cellophane, prior to enclosure by the protective sheath 44, such flexible covering separating from the balloon upon its inflation. The aerodynamically-shaped marker balloon may have the shape of a dirigible with a small parachute at the aft end. See FIG. 6*c*. This parachute aids in deceleration during inflation and improves the flight stability of the inflated marker. Generally, a sphere provides a maximum volume-to-surface and therefore a maximum lift-to-weight ratio, as well as uniform visibility from all angles, but it tends to become unstable and to lay over at winds in excess of 10 knots. A dirigible of the same volume, however, meets aerodynamic stability requirements, although its lift-to-weight ratio is smaller.

The marker may be manufactured from ½ mil Kapton, coated with ½-mil flame-orange pigment for a highly-reflective surface to achieve maximum contrast against a jungle background, with a maximum diameter (close to the forward end) of 38 cm., tapering off to a point aft, and a total length of 180 cm. About 120 liters of gas are required to inflate it. The total weight of this marker and rigging material, including the inflation valve and the tether line, is 123 grams resulting in a positive lift of 21.6 grams.

Figure 4:
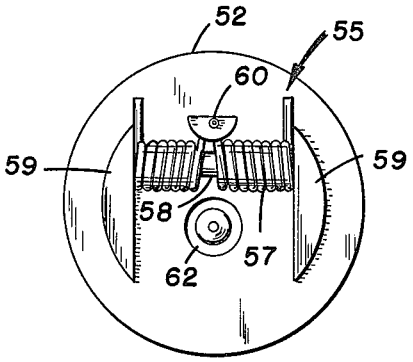
FIG. 4 is a view along line 4—4 of FIG. 2 showing the percussion actuator of the gas generator.

Attached to the marker balloon 42 by way of the nozzle 48 threaded onto the nipple 50 is the hydrogen gas generator 52 (FIG. 2*c*). Nozzle 48 has a tapered end 54 for insertion into the balloon and an intermediate, reduced-diameter portion 56 to receive a securing band (not shown) for releasably attaching the balloon to the nozzle. Upon full inflation, internal pressure of the balloon forces the securing band off the nozzle to permit the spent gas generator 52 to fall away, with the inflation valve in the balloon maintaining the pressure. The solid-state hydrogen gas generator 52 utilizes a reaction between metal hydrides and ammonium halides. The chemical reaction is initiated with a percussion primer which in turn ignites a small booster charge (not shown) within the generator 52. The hydrogen gas generator presently manufactured at the Naval Ordinance Station for the balloon marker generates 130 liters of hydrogen gas within 12 seconds, weighs 294 grams, and is disclosed more fully in the pending application Ser. No. 453,662, filed Mar. 21, 1974. The igniter end cap of the generator 52 may be seen more fully in FIG. 4, a view along line 4—4 of FIG. 2. The spring-loaded striker 55 includes a spring 57 wound about a shaft 58 mounted between upstanding support pieces 59 and supporting the firing pin 60. As shown the firing pin 60 is in the cocked position and held in this position by the assembled abutting arrangement of the generator 52 against the rocket 16. Upon separation of the rocket from the clamshells 24, the firing pin 60 strikes the head of the percussion primer 62, igniting the booster charge to initiate the hydrogen-generating chemical reaction within the generator 52.

The tractor rocket propulsion unit delivers sufficient thrust to penetrate dense jungle growth 150 to 200 feet in height, and then proceed to an altitude of 200 to 250 feet above the top of the growth to permit deployment of the payload. The rocket motor 16 is mass, line and spin stabilized, revolving at about 25 rps., by the gas flow through the canted exhaust ports 64 provided adjacent the head of the rocket. The rocket motor 16, shown in greater detail in FIGS. 3 *a–c*, contains a standard, double base propellant 68 which is ignited by the spring-actuated striker 90 in the launcher tube 12 to strike a percussion primer 66 inbedded in the rocket motor 16. With reference to FIG. 3*a* showing of cross section of the rocket motor 16, the structure of the assembly can be more clearly seen. At the front of the rocket is a circular nozzle element 98 having a plurality of canted, exhaust outlets 64 to vent the combustion gases from the exhaust chamber 100 within the nozzle element. Attached to the nozzle element 98 is the forwardlytapered motor case 102 providing a cylindrical inner volume to receive the propellant grain 68 in the form of a cylinder wrapped with an inhibitor 101, and having an axial bore 104 to provide the burning surface. The after surface of the nozzle element 98 is perforated to provide gas communication between the bore 104 and the exhaust chamber 100, the perforation being sealed by plug 99 of laminated foil and plastic which is ruptured upon ignition of the propellant 68. Motor case 102 has an annular, recessed, threaded portion at each end; at the forward end to mate with the nozzle element 98 and at the aft end to receive the circular bulkhead 106 which houses the primer 66 and igniter, and provides the tongue-and-groove-like elements which fit with the groove 32 in the positioning ring 30 on the clamshells 24. The interfaces between the motor case 102, the nozzle element 98 and the bulkhead 106 are suitably sealed with sealant 107.

Bulkhead 106 has a circumferential collar on the forward face in the form of a truncated cone, internally threaded to mate the motor case 102, and a cylindrical aft portion. On the forward surface of this aft portion, directly inline with the axial bore 104 of the propellant grain 68, is a central recess 110 to receive an ignition charge 112, the charge being maintained in the recess 110 by a charge retainer 114. The primer 66 is contained within the primer holder 108 which, in turn, is received within a bore 109 provided in the bulkhead 106 and secured in position by a roll pin 118. A drilled hole 116 in the primer holder 108 aligns with a similar passage 117 in the bulkhead 106 to provide communication between the primer 66 and the igniter charge 112.

Figure 3C:
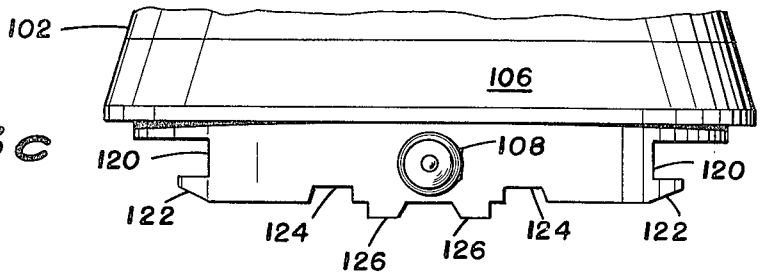
FIGS. 3a – 3c show details of the rocket.
Figure 3B:
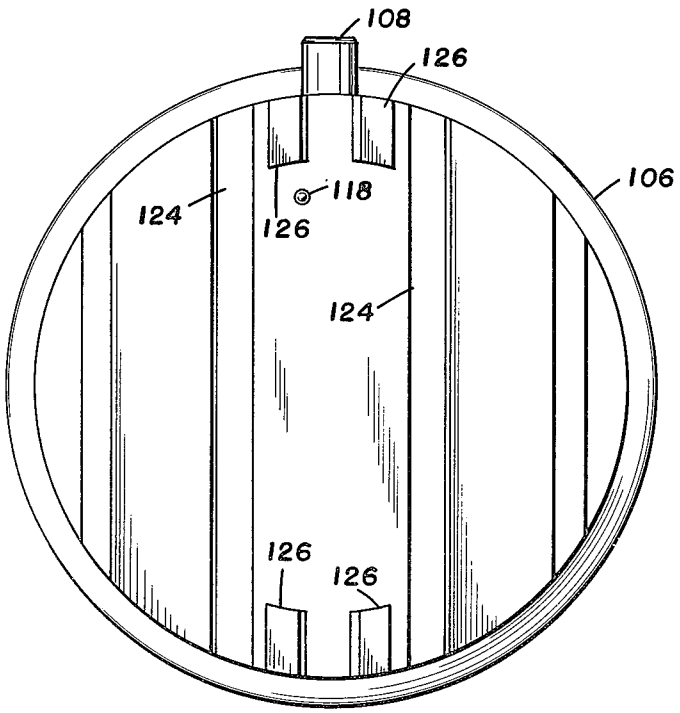
Figure 3A:
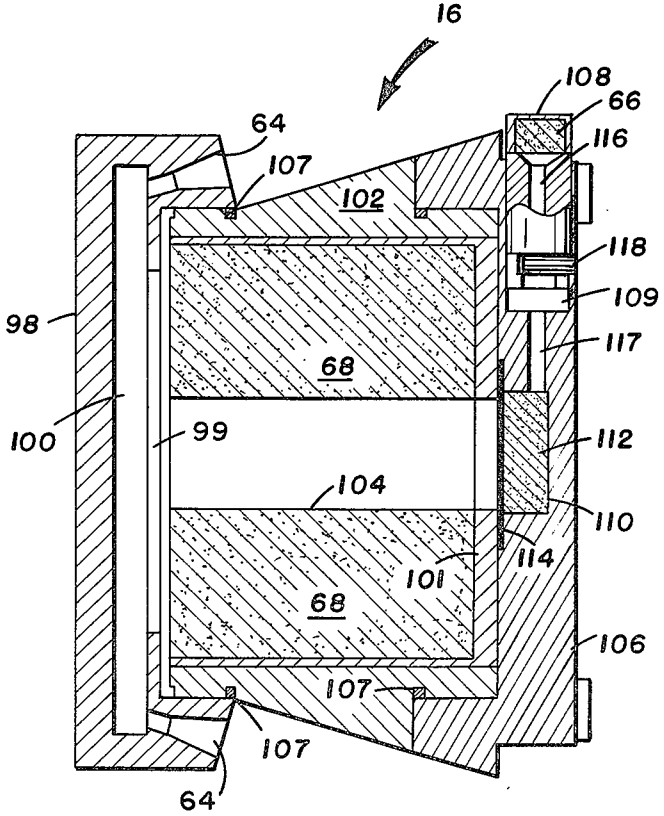

The positioning elements on the aft surface of the cylindrical portion of the bulkhead 106 can be more clearly seen in FIGS. 3*b* and 3*c*. Parallel with a centerline through the primer holder 108 are a pair of recessed grooves 120, cut along a chord at the lateral extremities to leave an extending tongue 122 on each side (FIG. 3*c*). A pair of shallow grooves 124 extend across the aft surface of the bulkhead 106 and two pairs of upstanding lugs 126 are provided between and at the ends of the grooves 124. In assembling the clamshells to the rocket motor, the groove 120 and tongue 122 on the bulkhead mate with the tongue 35 and groove 32 on the positioning ring 30; the pins 33 on ring 30 extend into the shallow grooves 124 on the aft surface of the bulkhead 106; and lugs 126 serve to support the lateral edge of the clamshells 24. Thusly assembled, the clamshells are capable of a slight pivotal motion about the mating tongue-and-groove elements.

Figure 5:
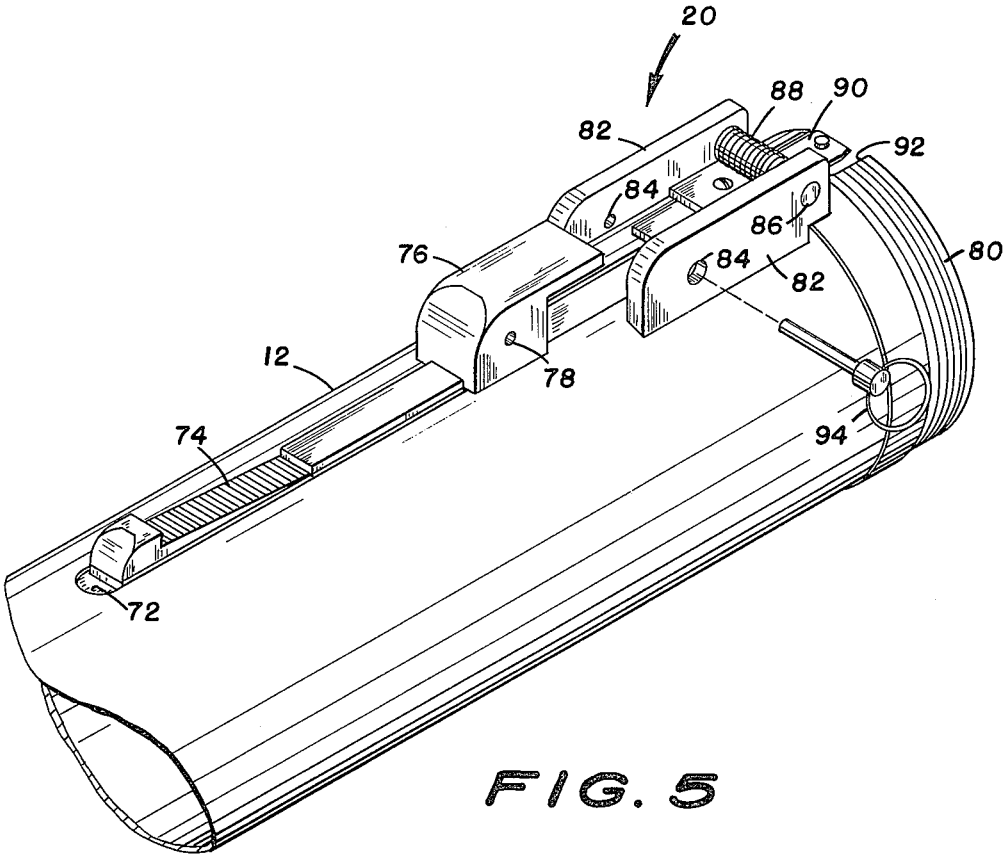
FIG. 5 is a detailed view of the slide-release ignition actuator.

The ignition actuator, shown in greater detail in FIG. 5, is similar to a flashlight slide and is designed so that the rocket can be launched with the use of only one hand. The surface of the launcher tube 12 has a shallow groove 72 approximate the open, forward end to receive a slide 74 having an upstanding inverted hollow receptacle 76 with a hole 78 through the sides thereof. At the forward end of the tube 12, just aft of the threads 80 is a pair of upstanding ears 82 between which the receptacle 76 may slide. Holes 84 in ears 82 align with holes 78 in the "safe" position of the ignition actuator 20. Mounted on a pin 86, transversely supported on the upstanding ears 82 is a spring 88 which biases the striker 90 toward the release position shown in FIG. 5. A cutout 92 in the open end of launcher tube 12 permits the percussion primer 66 on the rocket 16 to extend through. In the armed position, striker 90 is folded down between the ears 82 and maintained in this position by the receptacle 76, with the slide 74 pushed fully forward so that the receptacle 76 overlies the striker 90. A safing pin 94 is inserted through the aligned holes 78 and 84 to prevent accidental release of the striker. It should be noted that with the launcher tube cap 78 in place, the percussion primer 66 is covered, thus adding an additional degree of safety since it prevents contact between strikes 90 and primer 66 in the event of accidental release of the slide actuator 20.

The gas generator 52, marker balloon 42 within the protective sheath 44 and the tether line ball 38 form the payload which is held together by the two clamshells 24 (see FIG. 2*a*). The clamshells are hinged at the base of the rocket motor 16, as previously described, and then pinioned close to their opposite end with the pin 40 inserted through the holes 36 in each of the half disk 28. The rocket motor 16/payload 14 is inserted as a unit into the launcher tube 12 (see FIG. 1) and the cap screwed on. The rocket-deployed balloon marker system 10 is now fully assembled and ready for use.

Figure 6C:
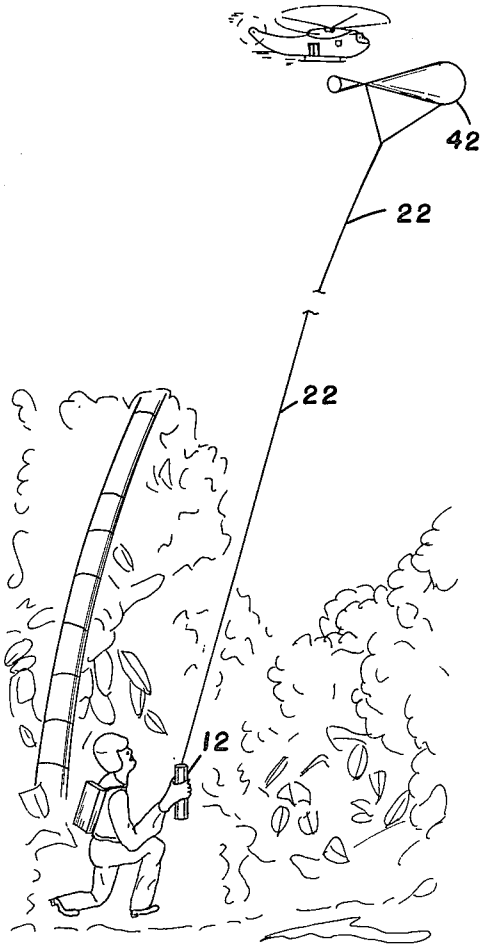
FIGS. 6*a*, *b*, *c* are pictorial showings of the balloon marker system in operation.
Figure 6B:
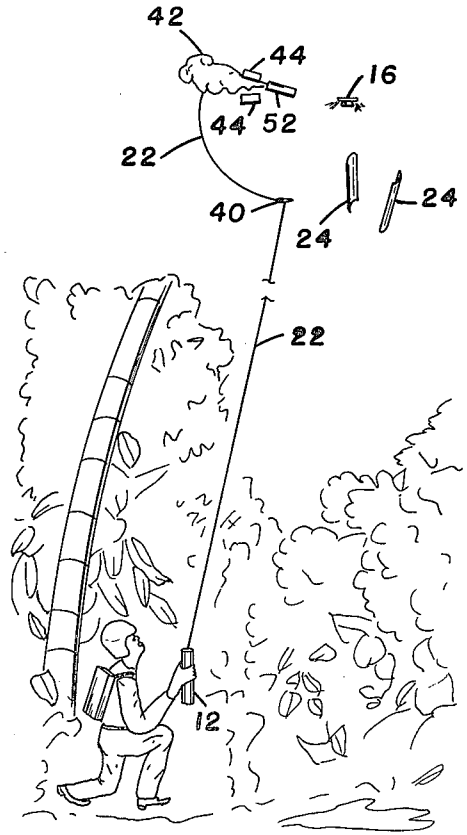
Figure 6A:
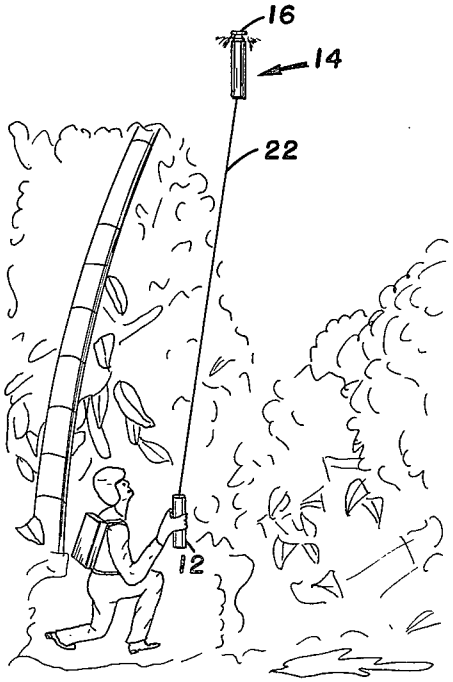

FIGS. 6 *a–c* illustrates the sequences in the operation of the marker system 10. Cap 18 is removed to expose primer 66 in rocket 16 and the launcher tube 12 is directed toward a clearing or opening in the vegetation. Ignition of the rocket motor is achieved by pulling the safing pin 94 and displacing the slide 74, permitting the striker 90 to actuate the primer 66 which ignites the rocket motor 16 by setting off the ignition charge 112. The rocket motor lifts the payload to altitude through the vegetation, paying out the tether line 22 attached to the launcher tube 12 (FIG. 6*a*). At approximately 450 feet, the tether line becomes taut and pulls the pin 40 which releases the clamshells 24 (FIG. 6*b*). When the clamshells open, the rocket motor 16 disengages from the gas generator 52 and releases the striker 55 which, then, actuates the generator and inflation of the marker balloon 42 begins. Commencement of balloon inflation and air resistance causes the split protective sheath 44 to separate, completely freeing the balloon. As soon as the marker balloon 42 has reached a slight positive pressure, the gas generator 52 separates from the marker, thus allowing it to float above the launch position at an altitude determined by the length of the tether line (FIG. 6*c*).

The high-contrast surface of the marker balloon can easily be spotted by a search aircraft. The exact launch position can be determined by following the tether line, which may be made more visible by attaching streamers to it.

Obviously, numerous modifications and variations of the present invention are possible in the light of the above teachings. For example, other sources of lighter-than-air gas can be used for balloon inflation other than the hydrogen generator, such as pressurized hydrogen or helium which would be released by suitable spring-actuated plunger means known in the art. Also the visibility of the balloon may be further enhanced by fabricating it from retroreflective material. It is therefore to be understood that within the scope of the appended claims the invention may be practiced otherwise than as specifically described herein.

What is claimed as new and desired to be secured by Letters Patent of the United States is:

1. A portable, rocket-deployed, tethered position marker system comprising:

an inflatable marker assembly including an inflatable balloon, and a source of gas for inflating said balloon;

a rocket for launching said marker assembly to a predetermined altitude;

a separable casing attached to said rocket for containing said marker assembly;

a portable, hand-held launch tube for containing and for launching said rocket and said attached casing; and a tether line stored within said casing for attaching said balloon to said launch tube, whereupon actuation said rocket is launched from said launch tube, said tether line is removed from said casing, said casing separates from said rocket at a predetermined altitude, and said balloon is permitted to be inflated and to remain tethered to said launch tube.

2. The position marker system of claim 1 wherein said separable casing is a cylinder split to form half shell segments when separated.

3. The position marker system of claim 2 wherein said separable casing is secured together and attached to said rocket by a removable pin tied to said tether cord at a selected length from the end secured to said launch tube, whereby deployment of said length of cord removes said pin permitting said casing to separate.

4. The position marker system of claim 3 wherein said rocket is of the tractor type having:

solid fuel grains;

a plurality of propulsion nozzles canted to provide spin stability during flight; and a percussion-activated fuel ignition means.

5. The position marker system of claim 4 further comprising a manually-operable rocket propellant ignition control means positioned on said launch tube for actuating said rocket.

6. The position marker system of claim 5 wherein said ignition control means comprises a displaceable slide release and a spring-loaded striker held in the cocked position by said slide release, whereby displacement of said slide release permits said striker to impact on said percussion-activated fuel ignition means on said rocket.

7. The position marker system of claim 6 wherein said source of gas is a solid fuel hydrogen generator.

8. The position marker system of claim 7 wherein said hydrogen generator includes a percussion-activated primer to initiate the hydrogen-generation chemical reaction in said solid fuel.

9. The position marker system of claim 8 wherein said hydrogen generator primer is spring-loaded and is released by separation of said separable casing from said rocket.

10. The position marker system of claim 8 further comprising means for releasing said hydrogen generator after inflation of said balloon.

11. The position marker system of claim 10 further comprising separable protective sheaths enclosing said balloon.

12. The position marker system of claim 11 wherein said protective sheaths comprise a pair of separable half shells discarded after balloon inflation.

13. The position marker system of claim 12 further comprising a removable closure cap threadably positioned on said launch tube.

* * * * *